US007164989B2

(12) United States Patent
Dirks et al.

(10) Patent No.: US 7,164,989 B2
(45) Date of Patent: Jan. 16, 2007

(54) WARHEAD FUZING SYSTEM

(75) Inventors: Richard A. Dirks, Cincinnati, OH (US); Max R. Cone, Sardinia, OH (US)

(73) Assignee: KDI Precision Products, Inc., Cincinnati, OH (US)

( * ) Notice: Subject to any disclaimer, the term of this patent is extended or adjusted under 35 U.S.C. 154(b) by 0 days.

(21) Appl. No.: 10/287,304

(22) Filed: Nov. 4, 2002

(65) Prior Publication Data

US 2004/0088112 A1 May 6, 2004

(51) Int. Cl.
*G01C 21/26* (2006.01)

(52) U.S. Cl. ..... 701/213

(58) Field of Classification Search ..... 701/200, 701/207, 213–214, 216–217, 220; 102/206–207, 102/210–211, 214–215; 244/3.1, 3.11, 3.2, 244/3.21; 342/62, 68
See application file for complete search history.

(56) References Cited

U.S. PATENT DOCUMENTS 5,123,612 A * 6/1992 Labroche et al. ..... 244/3.22
5,775,636 A * 7/1998 Vig et al. ..... 244/3.24
6,295,932 B1 * 10/2001 Kane, III ..... 102/221
6,573,486 B1 * 6/2003 Ratkovic et al. ..... 244/3.2
6,666,145 B1 * 12/2003 Nardone et al. ..... 102/489
2003/0140811 A1 * 7/2003 Bone ..... 102/266

FOREIGN PATENT DOCUMENTS

DE 21 20 735 * 7/1985

* cited by examiner

*Primary Examiner*—Thu V. Nguyen
(74) *Attorney, Agent, or Firm*—Harness, Dickey & Pierce, PLC

(57) ABSTRACT

A fuzing system and method for arming a fuzing system of a projectile using global positioning system (GPS) information from a GPS satellite system. The system determines when two independent verifications have been met before arming the system. The first verification is the detection of a physical characteristic such as sensed acceleration which, if detected by the system, satisfies the first verification criterion. The second verification is detection of flight data via the GPS signals that are received and processed by the system which also indicates that the warhead has been fired (or launched) from a gun, tube or other launching platform. Only when both of these verifications are satisfied does the system arm or permit arming of the system. The use of GPS information to assist in making the second verification reduces the complexity of the system since GPS signals are typically already being used to guide the projectile.

8 Claims, 2 Drawing Sheets

WARHEAD FUZING SYSTEM

FIELD OF THE INVENTION

The present invention relates to fuzing systems for warheads, and more particularly to a method of using global positioning system (GPS) data in fuzing systems regulated by military specifications.

BACKGROUND OF THE INVENTION

Fuzing systems function as part of military ordnance in part by providing independently determined redundant confirmations of specific conditions that must be met prior to the removal of the safety locks which would otherwise prevent warhead function. Design criteria governing the operation of arming devices as part of fuzing systems is established by MIL-STD-1316, which requires that the design of the fuzing system include the ability to discern and evaluate at least two independent physical conditions confirming a proper launch of the warhead. These conditions are selected according to the anticipated operating profile of the warhead, and implemented in such a way that they cannot be simulated or artificially induced by accident, such as by mishandling of the warhead by weapons handling personnel. For example, an artillery projectile may experience launch acceleration of 15,000 earth gravities (483,000 ft/sec/sec) and spin rates, induced by the rifling twist in the barrel, of 90,000 rpm when fired, neither condition being easy to create in any condition other than an actual gun firing. In certain implementations, the two independent physical conditions such as launch acceleration and spin may be discernible simultaneously or sequentially within specified periods of time. In these ways a physical "signature" that cannot be artificially induced is defined, and the arming device will arm, thereby permitting subsequent detonation of the explosive warhead.

As ordnance systems have evolved, and specifically as ballistic trajectory projectiles have evolved into guided projectiles, spin, a frequently used and universally accepted physical condition, is no longer available. In particular, guided projectiles, missiles and rockets achieve improved accuracy at conventional or extended range by using aerodynamic control surfaces to fly to a designated target. Aerodynamic control surfaces, however, would be destroyed by the spin rates of ballistic flight; therefore spin must be suppressed or eliminated. With spin eliminated, one of the most commonly used signatures for proper launch is not available for use in the fuzing systems of guided weapons.

Accordingly, a need exists for a warhead fuzing system utilizing an alternative condition for confirming the proper launch of the warhead before the warhead is armed.

SUMMARY OF THE INVENTION

The present invention provides a fuzing system for a warhead. In order to activate the warhead, the fuzing system must receive two independent verifications that the warhead has been fired (or launched). The first verification is generally based upon a physical condition resulting from the firing (or launch) of the warhead from a gun, missile tube or other launching platform. A sensor measures the physical condition and generates a signal which provides a first verification that the warhead has been fired. The second verification is generated based on received GPS signals related to the flight of the warhead. An analyzer within the fuzing system uses GPS signals to compute values such as velocity or acceleration for the warhead. The analyzer transmits these values to a controller within the fuzing system. The controller receives both the first signal and the values from the analyzer and determines if the warhead has been fired. If the controller determines the warhead has been fired, then it permits subsequent sequential arming actions to continue. The use of GPS information as a second independent confirmation of the warhead firing reduces the complexity of the electronics associated with the arming mechanism of the warhead since GPS signals are already being used to guide the warhead to the target.

Further areas of applicability of the present invention will become apparent from the detailed description provided hereinafter. It should be understood that the detailed description and specific examples are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

The present invention is generally related to a fuzing system for a warhead. In this regard, the fuzing system will be described in the context of a fuzing system for use with a warhead requiring two independent conditions to be satisfied before arming the warhead. In particular, this invention is directed to a warhead using a physical launch condition, such as an acceleration or a velocity, as the first independent condition and an in-flight condition for the second independent condition that must be met before enabling the fuzing system. However, it is to be understood that the principles embodied herein are equally applicable to other types of warheads and warhead fuzing systems.

Figure 1:
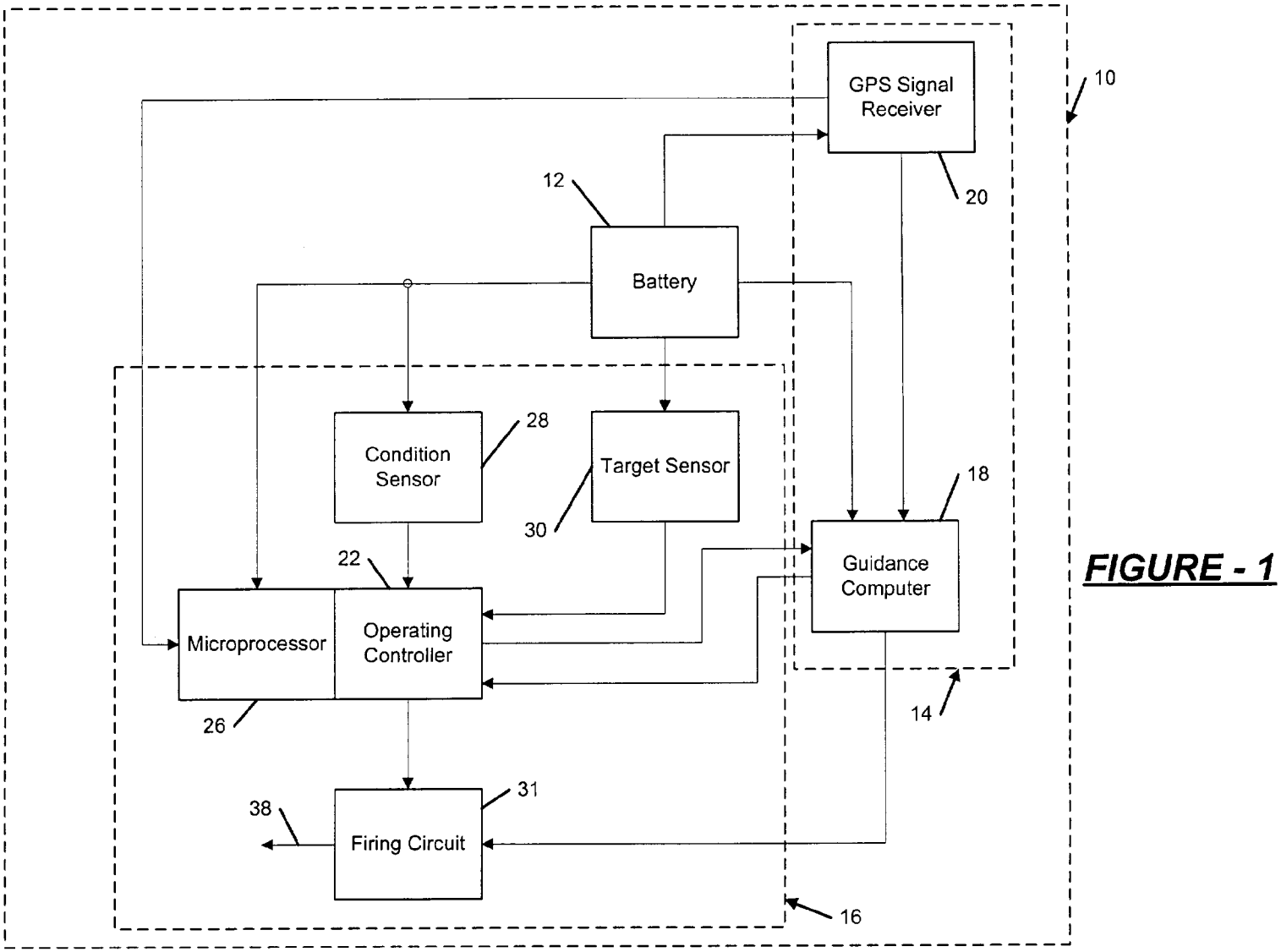
FIG. 1 is a functional block diagram of a warhead fuzing system according to a preferred embodiment of the present invention.

With reference to FIG. 1, a warhead 10 is shown in accordance with a preferred embodiment of the present invention. The warhead 10 receives power from a battery 12. The battery 12 provides power to operate a navigational system 14 and a fuzing system 16.

The navigational system 14 acts to guide the projectile to which the warhead 10 is attached to its target. A guidance computer 18 of the navigational system 14 receives three coordinate axes positional data and time data regarding the position of the warhead 10 from a GPS (Global Positioning System) signal receiver 20. The positional data and time data received by the GPS signal receiver 20 is rapidly based upon data received from several GPS satellites (not shown). The guidance computer 18 uses the data from the GPS signal receiver 20 to direct and maintain the projectile, and thus the warhead 10, on the proper path to the target. The guidance computer 18 is in communication with the fuzing system 16.

The fuzing system 16 includes an operating controller 22 which is in bidirectional communication with the guidance computer 18 of the navigational system 14. Typically, the guidance computer 18 communicates to the operating controller 22 specific mission operating data which is either accepted or rejected based upon whether launch has been verified by the fuzing system 16. Typically, the operating controller 22 communicates the status of the fuzing system 16 to the guidance computer 18. The operating controller 22 determines if the warhead 10 should be armed based on signals received from a condition sensor 28 and data analysis performed in the operating controller 22, in one preferred form a microprocessor 26 within the operating controller 22.

The condition sensor 28 monitors an inherent characteristic of a moving warhead 10, such as, for example, sensed acceleration, and transmits this value to the operating controller 22. The operating controller 22 compares the sensed value from the condition sensor 28 to a predetermined acceptable value or a predetermined range of values. If the value is within the predetermined range, the operating controller 22 determines that one of the arming conditions has been met. Alternatively, the condition sensor 28 may detect a physical condition and communicate the existence of said condition to the operating controller 22.

The microprocessor 26 receives positional and time data from the GPS signal receiver 20 and uses this data to calculate at least one of a velocity or an acceleration of the warhead 10. The velocity and/or acceleration computation from the microprocessor 26 is used by the operating controller 22 which compares this value to a predetermined value or range of values. If the computation from the microprocessor 26 matches the predetermined value or range of values, the operating controller 22 determines that one of the firing conditions has been met.

If the operating controller 22 determines that both of the conditions have been met based on the signals from the microprocessor 26 and condition sensor 28, the operating controller 22 will arm the fuzing system 16. A target sensor 30 communicates the distance to the target to the operating controller 22 and transmits a signal to the operating controller 22 when arriving at a predetermined distance from the target. If the fuzing system 16 is armed and the operational controller 22 receives the signal from the target sensor 30 that the warhead 10 has reached the target, the operating controller 22 will activate a firing circuit 31. The firing circuit 31 detonates the warhead 10.

Figure 2:
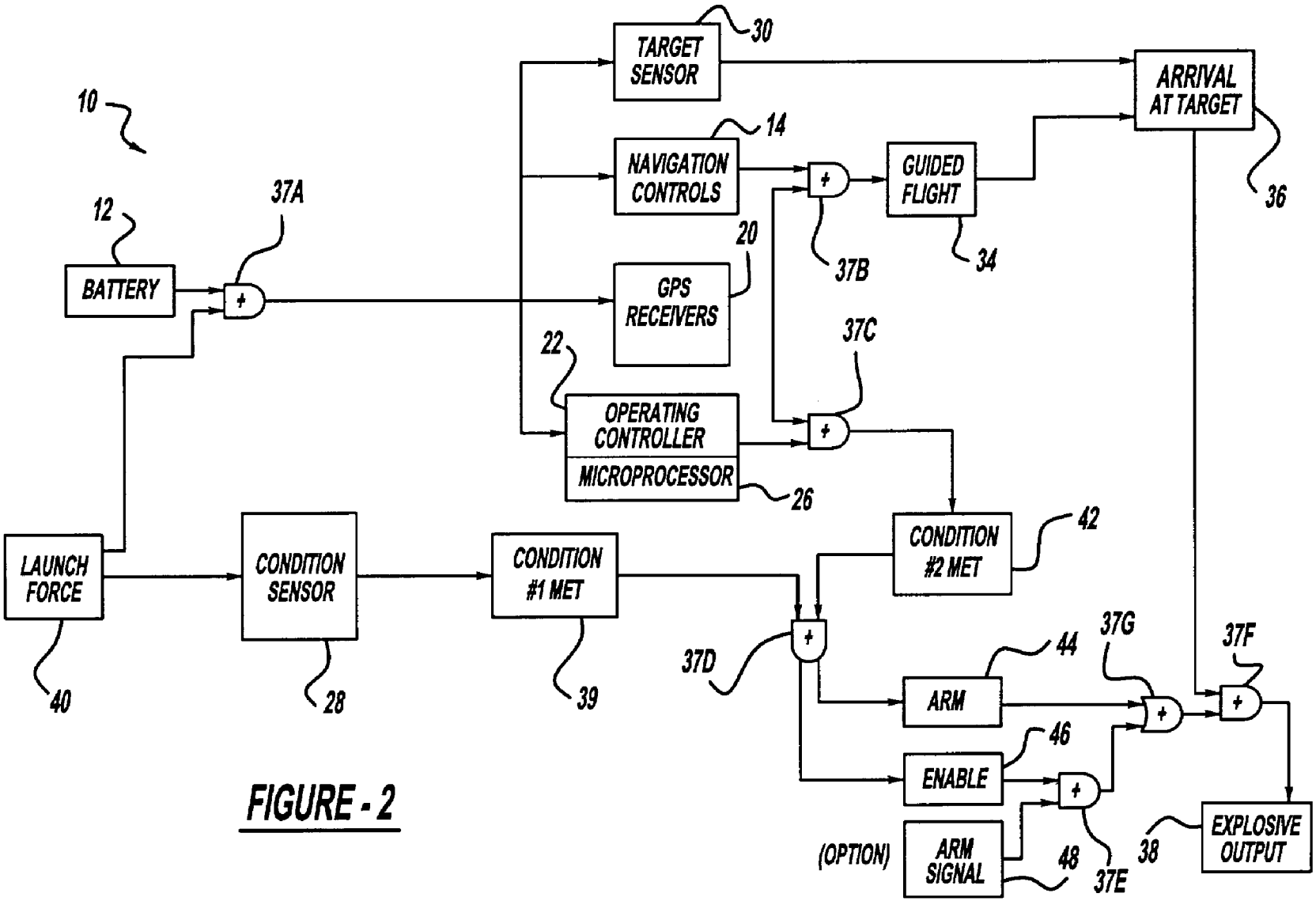
FIG. 2 is a functional control diagram for the warhead fuzing system of FIG. 1.

The operation of the fuzing system 16 is shown more specifically in FIG. 2. FIG. 2 includes a plurality of AND-gates 37A, 37B, 37C, 37D, 37E, 37F and an OR-gate 37G which function as known in the art. During operation, the fuzing system 16 first receives power from the battery 12. The battery 12 provides power to the target sensor 30, condition sensor 28, the microprocessor 26 and operating controller 22 within the fuzing system 16, the guidance computer 18 and also to the GPS signal receiver 20. The guidance computer 18 and the GPS signal receiver 20 determine a guided flight path 34 for the warhead 10. Once the warhead 10 is on the guided flight path 34, the signal from the target sensor 30 determines if the warhead 10 has arrived at a target 36. If the warhead 10 has arrived at the target 36 and received the proper signal from the fuzing system 16, an explosive output 38 is created.

In operation, the fuzing system 16 requires a first condition 39 and a second condition 42 to be met before arming. The first condition 39 is a physical condition, such as, for example a launch acceleration 40 caused by the firing of the warhead 10 from a barrel of a gun or missile tube. The condition sensor 28 serves to measure this physical condition, in this case the launch acceleration 40. If the launch acceleration 40 meets or exceeds a predetermined value based upon the typical acceleration experienced when the warhead 10 is fired from a barrel or missile tube, then the first condition 39 has been met.

The microprocessor 26 also detects if the second condition 42 has been met. Specifically, the microprocessor 26 receives the GPS data for the warhead 10 from the GPS signal receiver 20 and calculates the acceleration of the warhead 10 and/or the velocity of the warhead 10. If the microprocessor 26 determines that this flight information is within an acceptable range for a warhead fired from a barrel or missile tube, then it determines that the second condition 42 has been met.

With both the first condition 39 and second condition 42 are met, an "arm" signal 44 and an "enable" signal 46 are generated by the operating controller 22. Alternatively, an arm signal 48 could be provided to the fuzing system 16, with the operating controller 22 awaiting verification from the enable signal 46 that the fuzing system 16 can energize the firing circuit 31. Upon generation of the arm signal 44 and the enable signal 46, the operating controller 22 awaits confirmation that the warhead 10 has arrived at the target 36. If the arm signal 44 and enable signal 46 join with the signal indicating that the warhead 10 has arrived at target 36, then the warhead 10 is detonated by discharging the firing circuit 31 and explosive output 38 is produced.

The use of more sophisticated warheads has reduced the availability of suitable sources for independent conditions that reliably indicate when the warhead has been fired. Guided projectiles, in particular, require highly aerodynamic surfaces for flight and hence eliminate spin, generally the most used independent condition. The use of GPS information for determining the existence of the second condition, however, provides the ability to detect reliable flight data that forms an independent condition which does not affect the aerodynamics of the projectile carrying the warhead. Furthermore, the use of GPS information to assist in making the second verification reduces the complexity of the arming system since GPS signals are typically already being used to guide the projectile.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuzing system for arming a warhead of a projectile, said system comprising:

a sensor for generating a first signal indicative of a first operational condition of said projectile being met;

a receiver for receiving a plurality of global positioning signals from a global positioning system (GPS) relating to the flight of said projectile;

a processing system for computing a second signal from said plurality of global positioning signals relating to at least one flight characteristic of said projectile during flight;

a controller for receiving said first and second signals and determining there from that predetermined arming criteria have been met, whereupon said controller operates to generate a third signal for causing said warhead to become armed;

a power source in communication with said receiver, said processing system and said controller; and wherein said third signal is created when said plurality of global positioning signals are within a predetermined range of positional and time values, said third signal conveys at least one of velocity and/or acceleration of said warhead;

a second sensor coupled to said controller for generating a fourth signal when the warhead arrives a predetermined distance from, up to and including contact with said target.

2. The fuzing system of claim 1, wherein said third signal is generated based upon receipt of said first signal and said second signal.

3. A fuzing system for arming a warhead of a projectile, having a first sensor for generating a first signal based upon a physical condition indicative of a launched warhead, said system comprising:

a receiver for receiving a plurality of global positioning signals from a global positioning system (GPS) relating to the flight of said projectile;

a processing system for computing a second signal from said plurality of global positioning signals that relates to at least one flight characteristic of said projectile;

a controller for receiving said first and second signals and determining there from if predetermined arming criteria have been met, whereupon said controller operates to generate a third signal for arming said warhead;

a power source in communication with said receiver, said processing system and said controller;

a second sensor coupled to said controller for creating a fourth signal for detonating the warhead when the warhead arrives a predetermined distance from, up to and including contact with said target; and wherein said third signal is created when said plurality of global positioning signals are within a predetermined range of positional and time values, said third signal conveys at least one of velocity and/or acceleration of said warhead.

4. The fuzing system of claim 3, wherein said third signal is generated based upon receipt of said first signal and said second signal.

5. A method for arming a fuzing system carried by a projectile, comprising:

using a controller to receive and process radio frequency (RF) global positioning signals from a global positioning satellite system;

using said controller and said RE global positioning signals to determine the existence of a flight characteristic experienced by said warhead during a flight of said projectile toward a target when said global positioning signals are within a predetermined range of values of position and time;

arming said fuzing system if the existence of said flight characteristic is detected by said controller, a second sensor coupled to said controller for creating a fourth signal for detonating the warhead when the warhead arrives a predetermined distance from, up to and including contact with said target.

6. The method of claim 5 further including sensing for an acceleration of said projectile that indicates that said projectile has been launched from a projectile firing apparatus.

7. The method of claim 5, wherein said flight characteristic comprises monitoring a velocity of said projectile during its flight.

8. The method of claim 5, further comprising:

determining when said projectile has reached a predetermined distance from, up to and including contact with a target; and generating a firing signal to detonate said warhead.

* * * * *

UNITED STATES PATENT AND TRADEMARK OFFICE

CERTIFICATE OF CORRECTION

PATENT NO. : 7,164,989 B2
APPLICATION NO. : 10/287304
DATED : January 16, 2007
INVENTOR(S) : Richard A. Dirks et al.

It is certified that error appears in the above-identified patent and that said Letters Patent is hereby corrected as shown below:

Col. 6, line 6, claim 5, "RE" should be --RF--

Signed and Sealed this

First Day of May, 2007

JON W. DUDAS
*Director of the United States Patent and Trademark Office*